US006095434A

United States Patent [19]

Montenegro

[11] Patent Number: 6,095,434

[45] Date of Patent: Aug. 1, 2000

[54] PORTABLE AUTOMATIC MISTING DEVICE

[75] Inventor: Leonard Montenegro, Tempe, Ariz.

[73] Assignee: Arizona Mist, Inc., Gilbert, Ariz.

[21] Appl. No.: 08/947,228

[22] Filed: Oct. 8, 1997

[51] Int. Cl.[7] ..... B05B 9/043

[52] U.S. Cl. ..... 239/333; 239/152; 239/321; 239/331; 239/373; 222/175; 222/324; 222/386

[58] Field of Search ..... 239/152–154, 239/320, 321, 329, 331, 333, 373; 222/175, 309, 324, 379, 386

[56] References Cited

U.S. PATENT DOCUMENTS

| | | | |
|---|---|---|---|
| 2,096,042 | 10/1937 | Irwin | 239/321 |
| 2,741,511 | 4/1956 | Rollins | 239/331 X |
| 2,789,396 | 4/1957 | Jernander et al. | 239/154 X |
| 2,880,939 | 4/1959 | Esmay | 239/331 |
| 3,799,448 | 3/1974 | Nozawa et al. | 239/321 |
| 4,324,362 | 4/1982 | Stansbury, Jr. | 239/331 X |
| 5,031,839 | 7/1991 | Waldrum | 239/321 X |
| 5,620,140 | 4/1997 | Utter | 239/373 X |

*Primary Examiner*—Andres Kashnikow
*Assistant Examiner*—Steven J. Ganey
*Attorney, Agent, or Firm*—Jordan M. Meschkow, Esq.; Lowell W. Gresham, Esq.; Meschkow & Gresham, P.L.C.

[57] ABSTRACT

A portable automatic misting device (20) uses a misting device assembly (38) to automatically disperses a mist (36). The misting assembly (38) includes a hollow cylinder (40) that forms a liquid reservoir (50) that is in fluid communication with a one-way valve (76) that permits liquid flow into the reservoir (50). The reservoir (50) has fluid communication with a misting nozzle (34) through a hollow plunger rod (28). A plunger (42), a spring (48) and a portion of the hollow plunger rod (28) are located inside the hollow cylinder (40). The spring (48) is biased to move the plunger (42) and the hollow plunger rod (28) to automatically shrink the liquid reservoir (50).

12 Claims, 3 Drawing Sheets

PORTABLE AUTOMATIC MISTING DEVICE

TECHNICAL FIELD OF THE INVENTION

The present invention relates generally to the field of atomization of liquids. More specifically, the present invention pertains to a portable device for automatic mist generation.

BACKGROUND OF THE INVENTION

The use of misting devices to produce a cooling effect in a relatively high temperature environment is well known. The cooling effect is produced by an evaporation and absorption of an atomized or vaporized liquid (usually water) by a surrounding high temperature gas (usually air). This evaporation and absorption process reduces the air temperature in an area proximate to the mist. Atomizing or misting nozzles connected to a pressurized water supply are commonly used to produce this cooling mist or vapor.

A known application of this principal attaches multiple misting nozzles to a length of hollow pipe. The pipe is closed at one end and is attached to a pressurized water supply at another end. The pipe is attached to a fixed surface or support such as a post or several ceiling joists. This provides a cooling mist for a local area covered by the fixed misting system. Other applications use a portable or personal misting device that can be easily carried by an individual wherever they go and activated whenever the individual chooses. One such device incorporates an air pumping mechanism with a portable water bottle and a valve actuated misting nozzle. The air pumping mechanism uses a single cup seal attached to an end of a hollow plunger rod residing inside a hollow cylinder, to force air inside the hollow cylinder into the water bottle. For this device the hollow cylinder is located inside the water bottle and has passages, seals and one-way valves that allow uni-directional flow from the cylinder into the water bottle. By sliding the plunger rod back and forth inside the hollow cylinder, air is taken in through a one-way valve in the hollow plunger rod, and passed into the hollow cylinder where the cup seal forces the air through another one-way valve and into the water bottle. The valve actuated misting nozzle is attached to the top of the water bottle such that when the water bottle has a sufficient amount of water and compressed air, pressing or holding the valve down causes water to be dispersed through the misting nozzle.

Unfortunately this portable misting device requires excessive repetitive pumping action to provide sufficient air pressure inside the water bottle before misting can take place. The number of pumps determines the amount of air pressure inside the water bottle which determines the duration and pressure of the mist available to the individual. Longer lasting, higher pressure mist is desirable for cooling purposes. Unfortunately to achieve a desirably longer lasting higher pressure mist, the individual needs to perform more and more pump strokes to increase the air pressure in the water bottle. Furthermore, the valve actuating the misting nozzle must be held depressed during the misting operation, resulting in an inconvenient hands-on type of operation. This misting device uses compressed air to force water through the misting nozzle which requires seals and valves that can provide not only water-tight but air-tight connections as well.

Accordingly a need exists for a portable automatic misting device that can pressurize and automatically disperse a liquid through a misting nozzle for a desirable length of time. Such a device should also provide for ease of portability and operation.

SUMMARY OF THE INVENTION

Accordingly it is an advantage of the present invention to provide a portable automatic misting device.

Another advantage of the present invention is to provide a portable automatic misting device that is actuated by a single manual input pumping stroke.

Another advantage of the present invention is to provide a portable automatic misting device that is easy to carry and easy to operate.

Another advantage of the present invention is to provide a portable automatic misting device that generates a relatively high hydraulic pressure to produce the mist.

Another advantage of the present invention is to provide a portable automatic misting device that does not uses air-tight seals.

Another advantage of the present invention is to provide a portable automatic misting device that uses a remotely located liquid supply container to provide a relatively high quantity of desirable misting operations.

The above and other advantages of the present invention are carried out in one form by a portable automatic misting device that uses a misting device assembly to automatically disperses a mist. The misting device assembly has a hollow cylinder that forms a liquid reservoir. Located inside the hollow cylinder is a means for regulating the reservoir, including a one-way valve that is configured to permit liquid flow into the reservoir and a resilient member that is coupled to the regulating means and is biased to automatically shrink the reservoir. The assembly also includes a misting nozzle that is in fluid communication with the reservoir.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
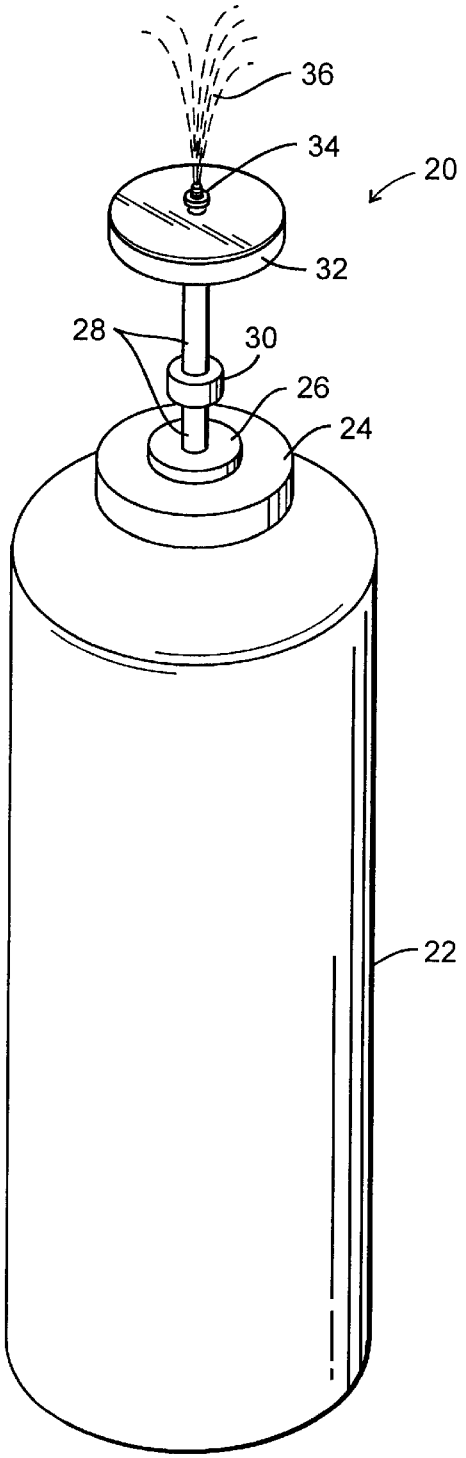
FIG. 1 shows a perspective view of a preferred embodiment of a portable automatic misting device.

FIG. 1 shows a diagram of a preferred embodiment of a portable automatic misting device 20 having a liquid container 22 with a removable coupling 24 surrounding an exit collar 26. A length of hollow plunger rod 28 extends through exit collar 26 and a plunger rod retaining collar 30 and attaches to handle 32. A misting nozzle 34 is attached to handle 32 and is capable of dispersing a mist 36.

Figure 2:
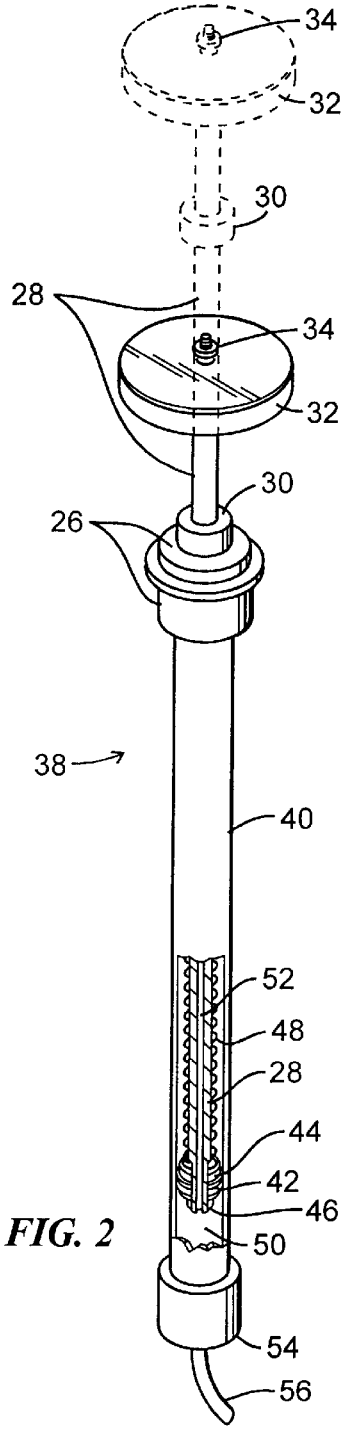
FIG. 2 shows a perspective and cut-away view of an exemplary portable automatic misting device assembly.

FIG. 2 shows a perspective, cut-away view of an exemplary portable automatic misting device assembly 38. For one embodiment, misting device 20 (FIG.1) is made up of misting device assembly 38 and liquid container 22 and a portion of assembly 38 is located inside liquid container 22 (see FIG. 1). A cut-away portion of assembly 38 in FIG. 2 reveals a hollow cylinder 40 containing a plunger 42 that is coupled to and surrounds a portion of hollow plunger rod 28. Plunger 42 is restrained between a plunger rod collar 44 that is attached to plunger rod 28 and a threaded coupling 46. A compression spring 48 is shown being coaxially mounted with and outside of plunger rod 28 and is restrained by plunger rod collar 44 and exit collar 26. Hollow cylinder 42 is shown forming a liquid reservoir 50 that has fluid communication with misting nozzle 34 through a centrally located flow passage 52 formed by the inside of hollow plunger rod 28. Hollow cylinder 40 also has an inlet collar 54 that is coupled to an inlet hose 56.

FIG. 2 additionally shows in phantom a second position of handle 32 and plunger rod 28. Solid lines in FIG. 2 show spring 48 being extended to a relatively relaxed state such that reservoir 50 has a minimum size. When handle 32 is moved to the phantom position, spring 48 is compressed to a relatively un-relaxed state such that reservoir 50 has a larger than minimum size (not shown).

Figures 3, 4:
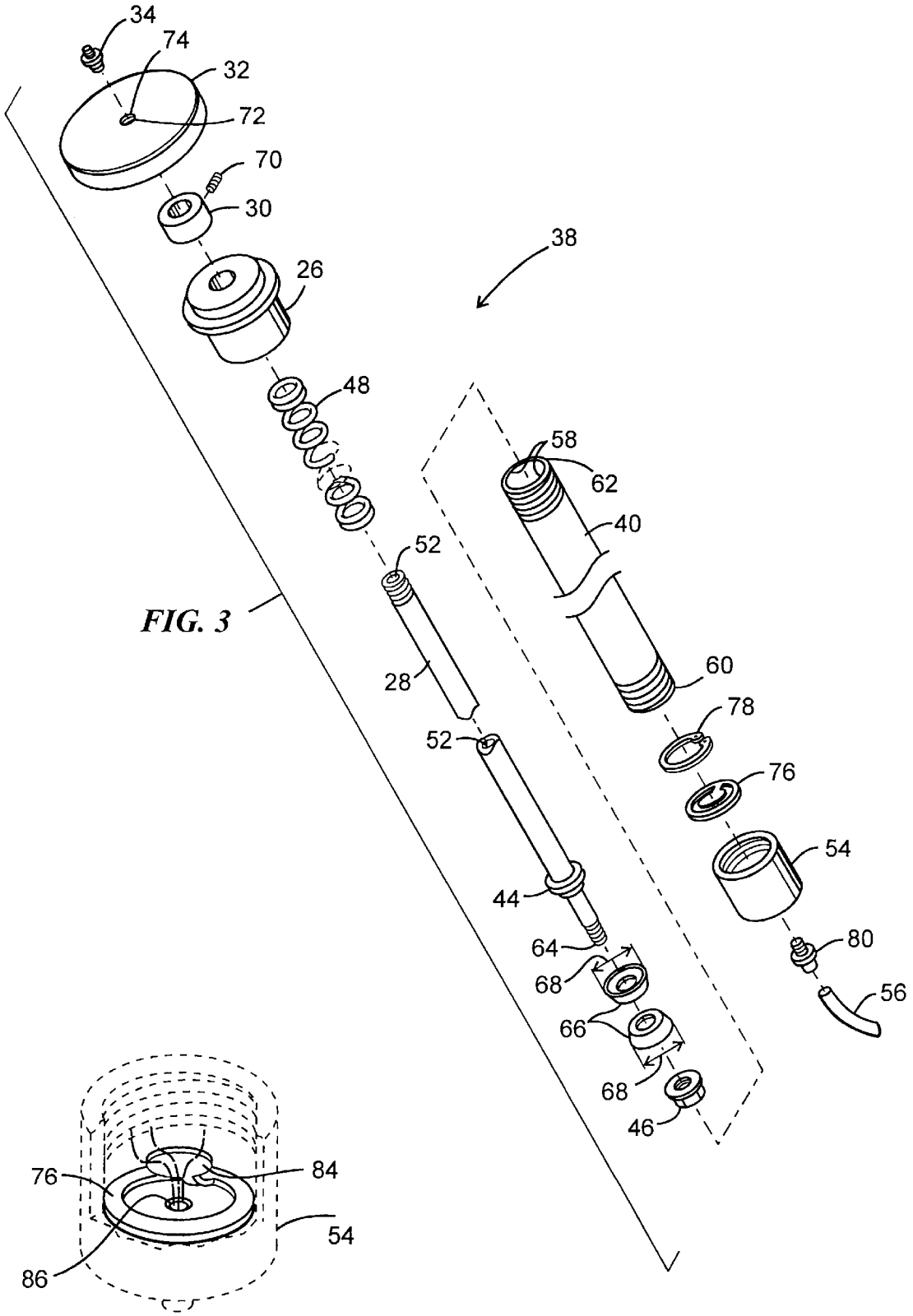
FIG. 3 shows an exploded perspective view of the portable automatic misting device assembly.
FIG. 4 shows a perspective view of an exemplary one-way flapper valve.

FIG. 3 shows an exploded perspective view of portable automatic misting device assembly 38. Hollow cylinder 40 is shown having an inner circumference 58, an inlet end 60, and an exit end 62. Inlet end 60 is located proximate reservoir 50 (FIG. 2) as is a reservoir end 64 of plunger rod 28. Plunger rod collar 44 is located or attached a distance from reservoir end 64 such that when assembled, washers 66 surround a portion of plunger rod 28 and are restrained by collar 44 and threaded coupling 46. Washers 66 are exemplary cup seal shaped washers, each having a longer side or diameter 68. Longer side 68 of washers 66 contact collar 44 or threaded coupling 46 when coupled to form plunger 42 (FIG.2). Compression spring 48 is a resilient member that is shown coaxially positioned around plunger rod 28. Retainer collar 30 has a set screw 70 that when tightened, couples retainer collar 30 to plunger rod 28 at a desired position to define the minimal size of reservoir 50 (FIG. 2). Handle 32 has an exit orifice 72 and a flow passage 74 connecting flow passage 52 of plunger rod 28 with exit orifice 72 of handle 32. A one-way flapper valve 76 is positioned inside inlet collar 54 by a valve retainer 78. Also shown is an inlet fitting 80 that couples to inlet collar 54 and to inlet hose 56.

FIG. 4 shows a perspective view of an exemplary one-way flapper valve 76 positioned inside inlet collar 54. Flapper valve 76 is shown having a flap 84 in an open position, so as to permit liquid flow through an inlet orifice 86 into reservoir 50 (FIG. 2). Those skilled in the art realize that a ball valve or any of a variety of one-way valves could be used to regulate liquid flow into reservoir 50 (FIG.2).

Figure 5:
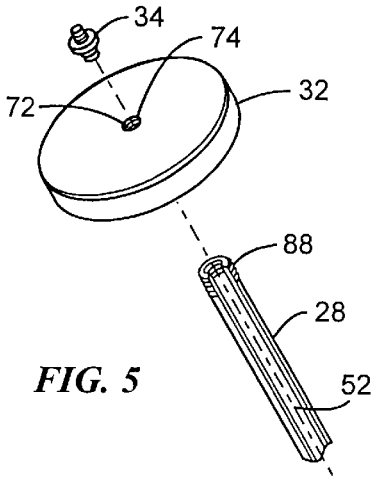
FIG. 5 shows an exploded perspective view of an exemplary misting nozzle, plunger rod and handle used by the portable automatic misting device assembly.

FIG. 5 shows an exploded perspective view of exemplary misting nozzle 34, hollow plunger rod 28 and handle 32. Plunger rod 28 is attached to handle 32 by a threaded coupling 88 and is configured to align plunger rod flow passage 52, with handle flow passage 74 and exit orifice 72.

Figure 6:
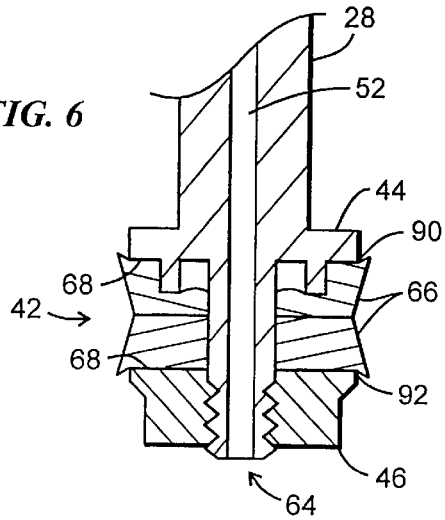
FIG. 6 shows a cross-sectional side view of a plunger and plunger rod coupling used by the portable automatic misting device assembly.

FIG. 6 shows a cross-sectional side view of the mutual coupling between plunger 42 and plunger rod 28. Plunger 42 is coupled proximate plunger rod reservoir end 64 and is formed by coupling washers 66 together (two shown). Each washer has a trapezoidal cross-section such that longer side 68 of one washer 66 overlaps a plunger rod collar outer diameter 90 and longer side 68 of the second washer overlaps an outer diameter 92 of threaded coupling 46. This overlapping washer material contacts hollow cylinder inner circumference 58 (FIG. 3) and forms a reliable water-tight seal where the contact is made.

Figure 7:
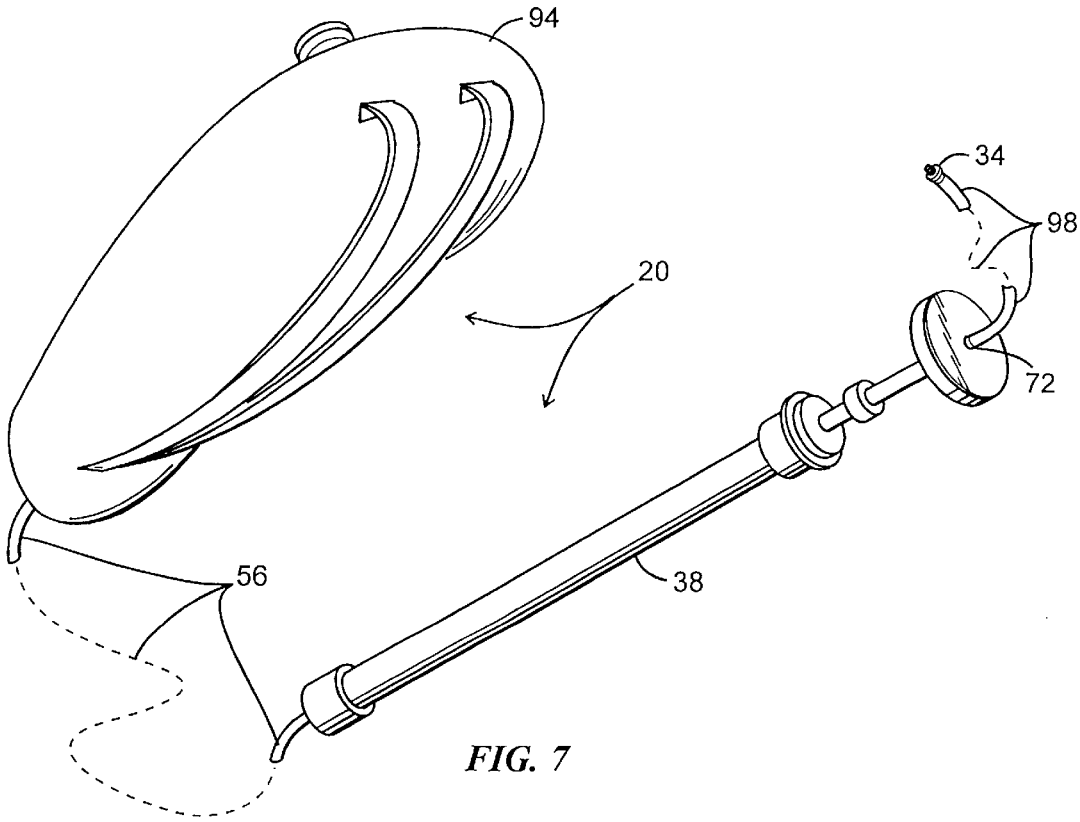
FIG. 7 shows a diagram of a preferred embodiment of a portable automatic misting device having a remotely located liquid supply container.

FIG. 7 shows a diagram of a preferred embodiment of portable automatic misting device 20. In this embodiment, misting device assembly 38 is coupled to a remotely located liquid supply container 94 by inlet hose 56. Separating misting device assembly 38 from liquid supply container 96 provides an ergonomic method for conveniently transporting or carrying relatively large amounts of liquid for providing a relatively high quantity of desirable misting operations. Inlet hose 56 provides a fluid connection between supply container 94 and one-way valve 76 (FIG. 4). In this embodiment, an exit hose 98 couples between exit orifice 72 and misting nozzle 34, allowing misting nozzle 34 to be directed independently from misting device assembly 38.

In operation misting device 20 is activated or charges by retracting or pulling up on handle 32 to a relative position as shown in phantom in FIG. 2. In this position spring 48 is compressed and biased to automatically shrink reservoir 50 when it is released. Flapper valve 76 is open and flap 84 is positioned to permit liquid flow through inlet orifice 86 (FIG. 5). Cup seal shaped washers 66 or plunger 42 form a liquid-tight seal with hollow cylinder inner circumference 58 (FIG. 3) and releasing handle 32 causes plunger 42 and plunger rod 28 to move towards inlet end 60. This movement creates hydraulic pressure that causes flapper valve 76 to close, positioning flap 84 over inlet orifice 86, preventing liquid flow through orifice 86 (FIG. 5, valve shown in open position). Moreover, releasing handle 32 shrinks reservoir 50 (FIG. 2) and forces a displaced quantity of liquid from reservoir 50 into flow passage 52 (FIG. 2 and FIG.3). This displaced fluid in flow passage 52 is forced (by hydraulic pressure) through handle flow passage 74, exit orifice 72 and misting nozzle 34 (FIG. 5), producing mist 36 (shown in FIG. 1).

For the above embodiments, spring 48 is a compression or coil spring. However, those skilled in the art will realize that a leaf spring or any of a variety of springs or resilient members could be used to regulate the size of reservoir 50. Moreover, plunger 42 is formed by coupling two cup seal shaped washers 66 together to provide a high pressure seal for the bi-directional operation of piston rod 28. This dual cup seal configuration provides delivery of a higher pressure liquid to the misting nozzle than is achieved by conventional single seal configurations.

For one preferred embodiment, liquid container 22 is configured to surround misting device assembly 38 and provide an easily portable and refillable liquid supply for misting operation (FIG. 1). In this embodiment, misting device 20 can be conveniently placed on a flat surface, then handle 32 may be extended (phantom position shown in FIG. 2) and released. A one stroke operation that provides a hands-off automatic mist dispersion for a desirable length of time (see FIG. 1) results.

In another embodiment, remotely located liquid supply container 94 (FIG. 7) provides fluid to assembly 38 through inlet hose 56.

In summary, portable automatic misting assembly 38 (FIG. 2) is easy to carry and operates by using a single manual input pumping stroke to generate a relatively high hydraulic pressure which is used for automatic mist dispersion of a liquid. In one embodiment, misting assembly 38 uses remotely located liquid supply container 94 (see FIG. 7) to carry a relatively large amount of liquid to provide a relatively high quantity of desirable misting operations.

Although the preferred embodiments of the invention have been illustrated and described in detail, it will be readily apparent to those skilled in the art that various modifications may be made therein without departing from the spirit of the invention or from the scope of the appended claims.

What is claimed is:

1. A portable misting device that automatically disperses a mist, said device comprising:

a hollow cylinder forming a liquid reservoir therein;

a plunger rod having a reservoir end that is proximate said reservoir, wherein said plunger rod is hollow to provide said fluid communication between said reservoir and said misting nozzle;

a plunger, said plunger being coupled proximate said plunger rod reservoir end and configured to form a liquid-tight seal between an inner circumference of said cylinder and said reservoir, wherein:

said plunger rod and said plunger together are configured for regulating size of said reservoir within said cylinder;

said plunger surrounds a portion of said plunger rod;

said plunger is restrained on a first side by a plunger rod collar at said plunger rod reservoir end; and said plunger is restrained on a second side by a threaded coupling such that said collar is attached to said plunger rod a distance from said reservoir end and said threaded coupling is coupled to said plunger rod at said reservoir end;

a one-way valve coupled to said cylinder and configured to permit liquid flow into said reservoir;

a resilient member coupled to said regulating means and biased to automatically shrink said reservoir; and a misting nozzle in fluid communication with said reservoir.

2. A portable misting device as claimed in claim 1 wherein said plunger is comprised of a first washer coupled to a second washer, each of said washers having a trapezoidal cross-section with a longer side, and said first and second washers are coupled such that said longer side of said first washer forms said plunger first side and said longer side of said second washer forms said plunger second side.

3. A portable misting device as claimed in claim 2 wherein said longer side of said first washer overlaps an outer diameter of said plunger rod collar and said longer side of said second washer overlaps an outer diameter of said threaded coupling.

4. A portable misting device as claimed in wherein said resilient member is a compression spring coaxially positioned around said plunger rod, and wherein:

said spring has a first end and a second end such that said first end is restrained at said plunger and said second end is restrained at an exit end of said cylinder;

said spring is configured such that when said spring is extended to a relatively relaxed state, said reservoir has a size that is a minimum size; and said spring is configured such that when said spring is compressed to a relatively un-relaxed state, said reservoir size is a larger size than said minimum size.

5. A portable misting device as claimed in claim 4 wherein said one-way valve is a flapper valve having a flap that opens to permit said liquid flow when said spring is being compressed and said flap closes to prevent said liquid flow when said compressed spring is being relaxed so that said reservoir shrinks and forces a displaced quantity of reservoir fluid through said plunger rod and said misting nozzle.

6. A portable misting device as claimed in claim 1 wherein a length of said plunger rod extends through an exit end of said cylinder and is attached to a handle by a threaded coupling.

7. A portable misting device as claimed in claim 6 wherein said handle has a first side, a second side and a flow passage, said first side having said plunger rod coupling, said second side having an exit orifice, and said flow passage connecting said plunger rod coupling and said exit orifice.

8. A portable misting device as claimed in claim 7 wherein said misting nozzle is mounted at said exit orifice.

9. A portable misting device as claimed in claim 7 wherein said exit orifice couples to a hose that is coupled to said misting nozzle.

10. A portable misting device that automatically disperses a mist, said device comprising:

a hollow cylinder forming a liquid reservoir therein, said cylinder having an inlet end and an exit end such that said reservoir is proximate said inlet end;

an inlet collar coupled to said inlet end;

an exit collar coupled to said exit end;

an inlet orifice extending through said inlet collar;

a movable plunger rod having an internal flow passage therein, a reservoir end proximate said reservoir, a collar located a distance from said plunger rod reservoir end, and a length of said plunger rod extending through said cylinder exit end;

a threaded coupling attached to said plunger rod reservoir end;

a plunger surrounding a portion of said plunger rod, said plunger being restrained on a first side by said plunger rod collar and on a second side by said threaded coupling, said plunger being formed by a first washer coupled to a second washer, said first and second washers each having a trapezoidal cross-section with a longer side, and said first and second washers being coupled such that said longer side of said first washer forms said plunger first side and said longer side of said second washer forms said plunger second side;

a compression spring coaxially positioned around said plunger rod and being restrained on a first end by said plunger rod collar and on a second end by said exit collar;

a one-way valve located proximate said inlet collar;

a handle having a first side attached to a plunger rod exit end by a threaded coupling, a second side having an exit orifice, and a flow passage connecting said plunger rod coupling to said exit orifice; and a misting nozzle coupled to said exit orifice.

11. A portable misting device as claimed in claim 10 wherein a liquid container is removably coupled to said cylinder and is configured to surround said cylinder.

12. A portable misting device that automatically disperses a mist, said device comprising:

a hollow cylinder forming a liquid reservoir therein;

a hollow plunger rod having a reservoir end located in said reservoir and a length that extends through an exit end of said cylinder;

a handle coupled to said extended length of said plunger rod;

a plunger at said plunger rod reservoir end and configured to form a liquid-tight seal between an inner circumference of said cylinder and said reservoir;

a one-way valve configured to permit liquid flow into said reservoir;

a compression spring coaxially positioned around said plunger rod, said spring being restrained on a first end at said plunger and on a second end at an exit end of said cylinder, said spring being configured such that when said spring is extended to a relatively relaxed state, said reservoir has a minimum size and when said spring is compressed to a relatively un-relaxed state, said reservoir size is a larger size than said minimum size; and a misting nozzle in fluid communication with said reservoir.

* * * * *

UNITED STATES PATENT AND TRADEMARK OFFICE

CERTIFICATE OF CORRECTION

PATENT NO. : 6,095,434
DATED : August 1, 2000
INVENTOR(S) : Leonard Montenegro

It is certified that error appears in the above-identified patent and that said Letters Patent is hereby corrected as shown below:

Claim 4,
Line 1, please insert -- claim 1 -- after "in" and before "wherein"

Signed and Sealed this

First Day of January, 2002

*Attest:*

*Attesting Officer*

JAMES E. ROGAN
*Director of the United States Patent and Trademark Office*